United States Patent [19]

Thorsen, Jr.

[11] Patent Number: 4,574,991

[45] Date of Patent: Mar. 11, 1986

[54] FASTENER FEEDING APPARATUS

[75] Inventor: Elmer J. Thorsen, Jr., Wood Dale, Ill.

[73] Assignee: Duo-Fast Corporation, Franklin Park, Ill.

[21] Appl. No.: 688,025

[22] Filed: Dec. 31, 1984

[51] Int. Cl.[4] ..... B25C 7/00; B27F 7/38

[52] U.S. Cl. ..... 227/3; 227/120; 227/119; 221/238; 414/16; 198/399

[58] Field of Search ..... 198/398, 399; 221/172, 221/238, 272; 227/120, 156, 3, 119; 414/16

[56] References Cited

U.S. PATENT DOCUMENTS

| | | | |
|---|---|---|---|
| 3,221,857 | 12/1965 | Keller | 198/399 X |
| 3,604,608 | 9/1971 | Mullaney et al. | 227/120 |
| 4,343,388 | 8/1982 | Du Bois et al. | 221/172 |

FOREIGN PATENT DOCUMENTS

| | | | |
|---|---|---|---|
| 1511512 | 5/1969 | Fed. Rep. of Germany | 198/399 |

*Primary Examiner*—Paul A. Bell

*Attorney, Agent, or Firm*—Mason, Kolehmainen, Rathburn & Wyss

[57] ABSTRACT

A fastener feeding apparatus is used to supply a pair of strips of detachably connected staples to a magazine of a fastener driving device in each loading cycle of the feeding apparatus. A plurality of pairs of strips of staples are supplied to an inclined receiving bin of the fastener feeding apparatus in a nested configuration and a pair of strips slide along the bin until positioned against a stop block in alignment with a pusher mechanism. When the fastener driving device is positioned adjacent an exit chute for receiving the strips of staples, the pusher mechanism engages one of the strips of staples and pushes the one strip of staples toward the exit chute. The other strip of staples is held in place by a stop so that the one strip is separated from the other strip of staples. Once the strips of staples are separated, the stop is retracted and the pusher moves both strips of staples along an orienting device adjacent the exit chute. When both strips of staples are properly positioned along the exit chute, the strips of staples are placed in the proper orientation as they tumble into the exit chute toward the magazine of the fastener driving device.

14 Claims, 11 Drawing Figures

FASTENER FEEDING APPARATUS

The present invention relates to a fastener feeding apparatus, and more particularly, to a feeder for supplying to a fastener driving device strips of detachably connected staples which are received or packaged nested together.

Various types of power operated fastener driving devices or tools are available for driving fasteners into various types of workpieces. The fastener driving tool may be manipulated manually by personnel or can be manipulated by a robot or other automated machinery in a factory. One such type of fastener driving device is a staple driving apparatus commonly referred to as a staple gun which includes a driver and some means for reciprocating the driver in a drive track. The staples are loaded into a magazine of the staple gun in sticks or strips of detachably joined staples. The strips are biased toward the drive track so that an individual staple in the strip is severed from the strip during each driving stroke of the staple gun and driven into the workpiece.

In order to load the magazine with a supply of staples, the strips of staples must be oriented in the same fashion so that the legs of the staples extend in the same direction from the crown portion of the staples. U.S. Pat. Nos. 3,189,220 and 3,640,608 are patents assigned to the assignee of the present application and disclose fastener feeders which can be used to load strips of staples into a magazine of a fastener driving device. In each of those patents, individual strips of staples are loaded into a receiving bin with the legs of the staples extending in the same direction so that the staples are properly oriented when fed into the magazine of the fastener driving device. However, most strips of staples are normally packaged nested together. In other words, two strips of staples are placed together with the legs of the staples of one strip extending in a direction opposite to the legs of the staples in the other strip with the legs on one side of each of the strips of staples located in between the legs of the other strip of staples. Consequently, it would be desirable to have a staple feeder that did not require the nested strips of staples to be separated and reoriented prior to loading the strips of staples into the feeder mechanism so that the strips of staples could be used in the feeder just as they are received.

The assignee of the present application has developed a fastener feeder into which nested strips of staples can be loaded. In this feeder, one of the nested strips of staples is separated from the other strip of staples by a pusher while the other strip is maintained in a fixed position by a stop pin. This separated first strip of staples is then oriented for loading into the end of a magazine of a fastener driving device. When a staple gun is positioned against the feeder for receiving a strip of staples, a second pusher pushes the first strip of staples into the end of the magazine. At the same time, the first pusher engages the second strip of staples and it is oriented and placed in alignment with the second pusher for loading into the staple gun when a staple gun is again positioned against the feeder. This type of fastener feeder requires the fastener driving device to be loaded from the end of the magazine and each loading cycle includes the loading of only one of the strips of staples from each nested pair of strips. In addition, each loading cycle involves two different pushers. One for separating and orienting a strip of staples and a second to push the oriented strip of staples into the end of the magazine of a fastener driving device.

Accordingly, objects of the present invention are to provide a new and improved fastener feeder apparatus for loading staples into a fastener driving device; to provide a new and improved fastener feeder apparatus for providing strips of staples to a fastener driving device which strips of staples are loaded into the feeder in a nested configuration; to provide a new and improved fastener feeder apparatus in which a pair of strips of staples nested together when loaded into the fastener feeder apparatus are separated by the feeder and both of the strips are loaded into a fastener driving device during the same loading cycle; to provide a new and improved fastener feeder apparatus which separates a pair of strips of staples nested together and properly orients the strips so that they can be concurrently loaded along the length of a magazine of a fastener driving device in one loading operation; and to provide a new and improved fastener feeder apparatus which utilizes one pusher to separate and load into a magazine of a fastener driving device a pair of nested together strips of staples during one loading cycle.

In accordance with these and many other objects, an embodiment of the present invention comprises an apparatus for feeding fasteners in the form of strips of staples to a power operated fastener driving device such as a staple gun which is used to drive individual staples contained in the strips into a workpiece. The fastener feeder includes a receiving bin or chute into which is placed a supply of strips or sticks of staples nested together. The receiving chute is inclined and the strips of staples slide along the receiving chute toward a stop block at the lowermost end of the receiving chute so that a nested pair of strips of staples are positioned in alignment with a pusher. When a fastener driving device is properly positioned with its magazine open against an inclined exit chute of the fastener feeder apparatus, a switch adjacent the exit chute activates a pneumatically operated pusher mechanism. The pusher mechanism moves the pusher towards the nested pair of strips of staples which are disposed against the stop blocx. A first pusher portion of the pusher engages the crown of the end staple in the first strip of staples which has its legs extending toward the bottom of the receiving chute and pushes that strip of staples towards the exit chute. The other or second strip of staples in the nested pair having the crown portions of the staples against the bottom wall of the receiving bin is maintained against the stop block by a stop pin that engages the crown of the first staple in that strip. As a result of the continued pushing of the first strip of staples by the first portion of the pusher, the first strip of staples is separated from the second strip of staples.

The first strip of staples is pushed under the influence of the pusher along a guide and an orienting or a tumbling device. The guide extends from the stop block and is positioned so that it engages the legs of the staples in the first strip of staples nearest the stop block adjacent or near the crowns of the staples. The other legs of the staples in the first strip slide along a slot in the tumbling device. The guide extends from the stop block and along the uppermost portion of the exit chute and prevents the first strip of staples from entering the exit chute until the strip has been pushed along the top of the exit chute to an appropriate position.

Once the first strip of staples has been completely separated from the second strip, a switch responsive to the position of the pusher causes the stop pin to be retracted. A second pusher portion on the pusher thereafter engages the crown of the endmost staple in the second strip of staples and pushes the second strip of staples toward the exit chute. The second strip of staples has the crown portions of the staples lying against the tumbling device and the leg nearest the exit chute against the guide. About the time when the second strip of staples has cleared the stop block, the first strip of staples is positioned beyond the guide. The weight of the crown portions of the staples in the first strip tends to cause the strip of staples to tumble or fall toward the exit chute with the crown portions of the staples toward the magazine of the staple gun positioned at the bottom of the exit chute. The second strip of staples also starts to tumble but because the crown portions of the staples are lying on the tumbling device and the legs of the staples are against the guide, the crown portions tend to slide off an inclined surface of the tumbling plate and slide along the exit chute with the crown portions extending toward the magazine of the staple gun. As a result, both the first and second strips of staples slide down the exit chute toward the open magazine of the staple gun with the legs of the staples extending in the same direction away from the magazine.

After the magazine of the staple gun has been filled with the first and second strips of staples, the staple gun is removed from the exit chute. The switch adjacent the exit chute responds to the removal of the staple gun and the pusher mechanism retracts the pusher so that a second pair of nested together strips of staples from the receiving bin moves against the stop block and in alignment with the pusher so that it is ready for the next loading operation.

Many other objects and advantages of the present invention will become apparent from considering the following detailed description in conjunction with the drawings in which:

FIG. 6 is a partial sectional view taken along line 6—6 of FIG. 5;

Figures 4, 5, 10, 11:
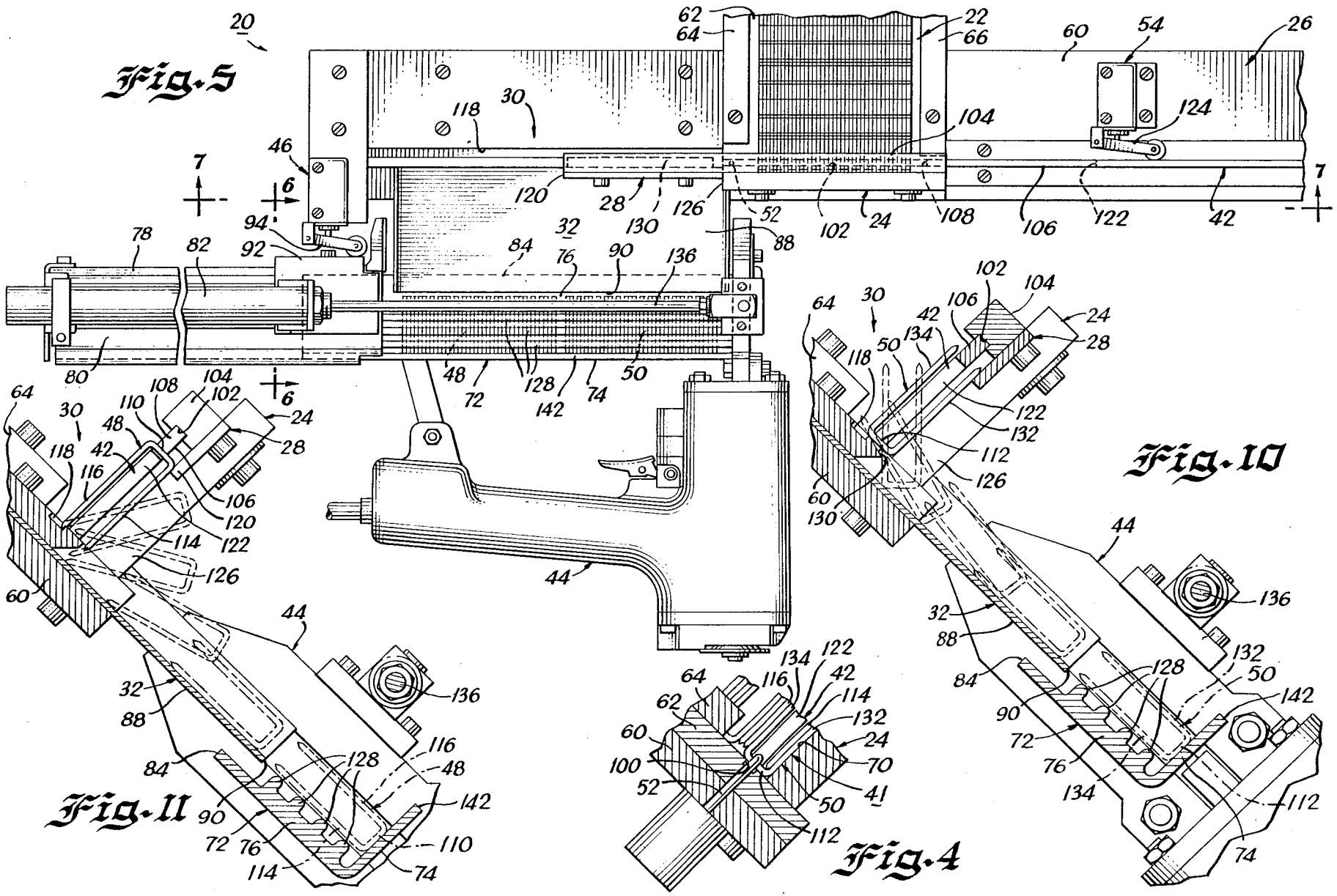
FIG. 4 is a partial sectional view taken along line 4—4 of FIG. 1.
Figure 9:
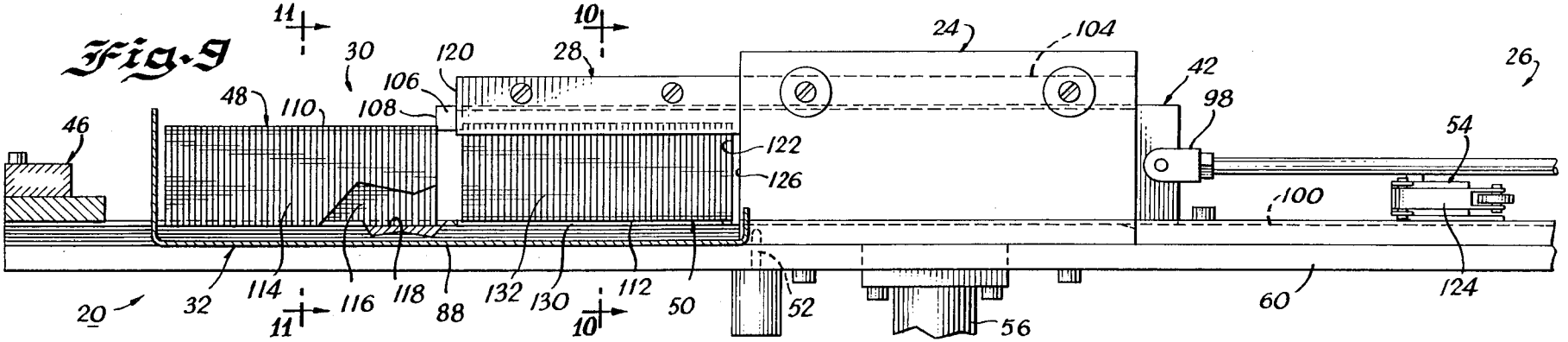
FIG. 9 is a sectional view taken along line 7—7 of FIG. 1 in the operational sequence of the feeder when the pusher has supplied both strips of staples to the exit chute and the strips of staples are ready to begin to tumble into the exit chute.

FIG. 10 is a sectional view taken along line 10—10 of FIG. 9 illustrating in phantom lines how one of the strips of staples will tumble into and slide along the exit chute into the magazine of the staple gun; and FIG. 11 is a sectional view taken along line 11—11 of FIG. 9 illustrating in phantom lines how one of the strips of staples will tumble into and slide along the exit chute into the magazine of the staple gun.

Figures 1, 2, 3, 5:
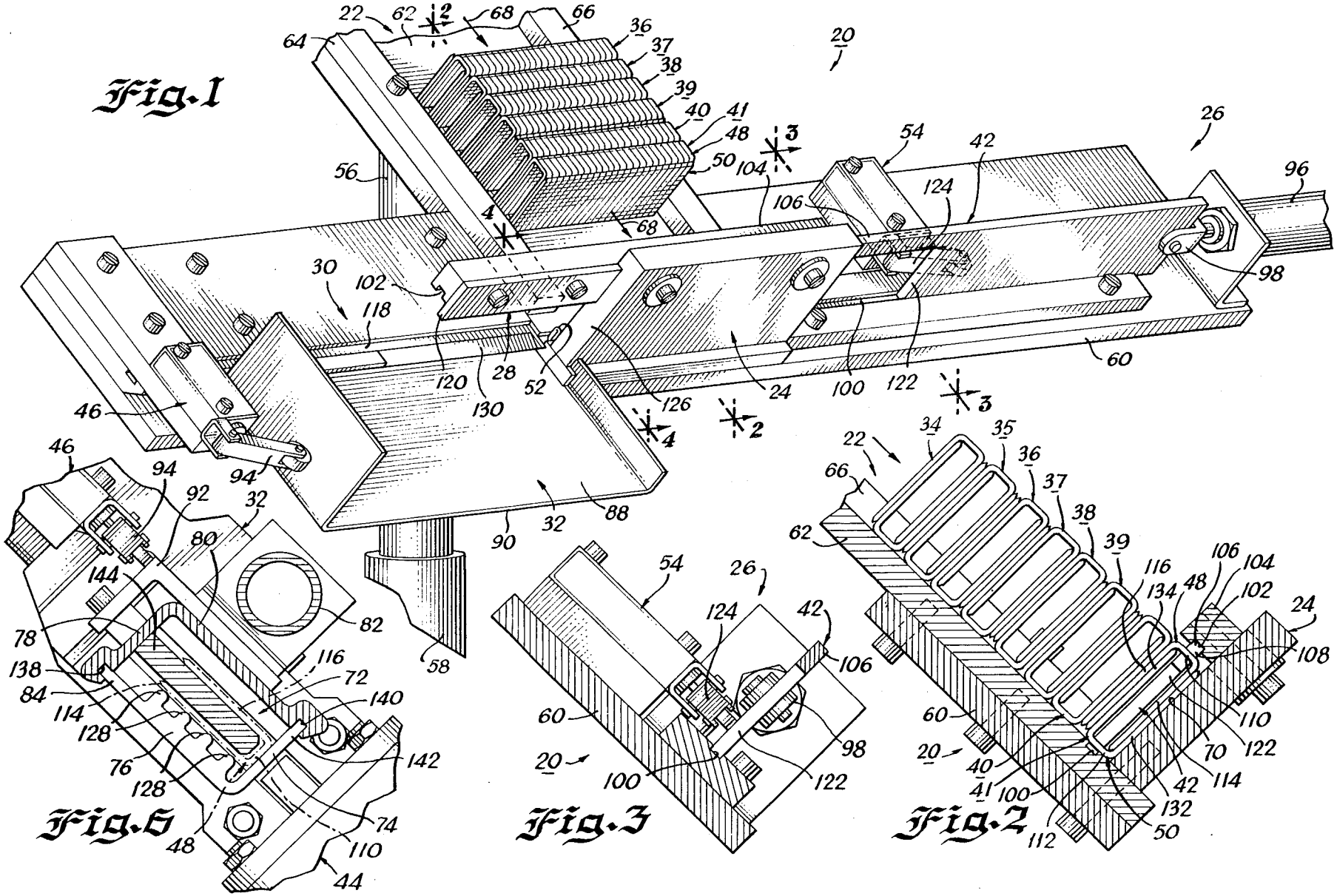
FIG. 1 is a perspective view showing the fastener feeder apparatus embodying the present invention.
FIG. 2 is a sectional view taken along line 2—2 of FIG. 1.
FIG. 3 is a sectional view taken along line 3—3 of FIG. 1.
FIG. 5 is a top elevational view showing the fastener feeder apparatus with a staple gun positioned against the exit chute into which staple gun staples are to be loaded (strips of staples as they would be loaded into the magazine of the staple gun are shown in phantom lines)

Referring now more specifically to FIG. 1 of the drawing, therein is disclosed a fastener feeder device for supplying strips of detachably connected staples to a fastener driving tool, which feeder is generally designated by the numeral 20 and which embodies the present invention. The feeder 20 includes a receiving bin 22, a stop block 24, a pusher mechanism 26, a guide 28, a tumbling or orienting device 30 and an exit chute 32. Pairs of strips of detachably connected staples 34–41 are loaded into the receiving bin 22 and slide along the receiving bin 22 toward the stop block 24. As best seen in FIGS. 1 and 2, the pairs of strips of staples 34–41 are loaded into the receiving bin 22 nested together as they are received from the manufacturer of the staples. As shown in FIG. 2, the first loaded pair of strips of staples 41 is positioned against the stop block 24 and in alignment with a pusher 42 which forms a part of the pusher mechanism 26. When a fastener driving tool, such as a staple gun 44 shown in FIG. 5, is positioned adjacent the bottom of the exit chute 32, a switch 46 is activated and the pusher 42 advances toward the pair of nested strips of staples 41. The pusher 42 engages one of the strips of staples 48 in the pair of strips of staples 41 and pushes it toward the exit chute 32 along the guide 28 and the tumbling device 30. The other strip of staples 50 in the pair of strips of staples 41 is maintained along the stop block 24 by a stop pin 52 (FIG. 4). Consequently, the movement of the pusher 42 separates the strip of staples 48 from the strip of staples 50.

Once the strip of staples 48 has been separated from the strip of staples 50, the pusher 42 has moved sufficiently toward the exit chute 32 (i.e., toward the left in FIG. 1) so that a switch 54 which has been held closed by the pusher 42 is allowed to open resulting in the stop pin 52 being retracted. The pusher 42 then engages the strip of staples 50 and pushes it along the guide 28 and the tumbling device 30. Once the staples 48 and 50 have been pushed along the guide 28 and the tumbling device 30 an appropriate distance, the strips of staples 48 and 50 slide down the exit chute 32 toward the staple gun 44. As will be discussed in more detail hereinafter, the guide 28 and the tumbling device 30 cause the strips of staples 48 and 50 to slide down the exit chute 32 in a proper orientation so that both strips of staples 48 and 50 enter the staple gun 44 in the proper orientation. After the staple gun 44 has been loaded with the strips of staples 48 and 50, such as shown by the strips of staples in phantom lines in FIG. 5, the staple gun 44 is removed from adjacent the exit chute 32 and the switch 46 is deactivated so that the pusher 42 is retracted to the position shown in FIG. 1 of the drawings.

The feeder 20 is mounted on pedestals 56 and 58 or other appropriate support structures. The pedestals 56 and 58 support the feeder 20 such that a base 60, the receiving bin 22 and the exit chute 32 are inclined as shown in FIG. 1 of the drawings. As a result of the base 60, the receiving bin 22 and the exit chute 32 being inclined, the strips of staples 34–41 slide along the receiving bin 22 toward the stop block 24 so as to be positioned in alignment with the pusher 42 and the strips of staples, such as the strips 48 and 50, become properly oriented for loading into the staple gun 44.

The receiving bin or chute 22 is generally channeled or U-shaped with a bottom or bight wall 62 and side leg walls 64 and 66. The nested strips of staples 34–41 are placed on the bottom wall 62 of the receiving bin 22 between the sidewalls 64 and 66 as illustrated in FIGS. 1 and 2 of the drawings. The bin 22 can extend a substantial distance away from the stop block 24 in order to hold a sufficient supply of strips of staples, such as the illustrated nested strips 34–41. Since the receiving bin 22 is inclined downwardly towards the stop block 24, the strips of staples 34–41 slide downwardly toward the stop block 24 in the direction indicated by arrows 68 in FIG. 1 of the drawings. The strips of staples 34–41 slide along the bottom wall 62 and are guided by the sidewalls 64 and 66 until the strips of staples 34–41 come to a resting position as illustrated in FIG. 2 of the drawing with the nested pair of strips of staples 48 and 50 positioned against an inner wall 70 of the stop block 24. When the strips of staples 48 and 50 are so positioned against the inner wall 70 of the stop block 24, the pusher 42 is in alignment with the strips of staples 48 and 50 and the pusher mechanism 26 is positioned as shown in FIGS. 1–3 in what might be termed a standby or ready state.

Referring now to FIG. 5 of the drawings, the staple gun 44 is shown just as it is being positioned adjacent the exit chute 32 in order to receive a pair of strips of staples, such as the strips of staples 48 and 50. The staple gun 44 is one of various types of power operated driving tools which can be used to drive individual staples into a workpiece or like. The staple gun 44 shown in FIG. 5 is a pneumatically operated staple gun 44 which has a driver reciprocally mounted in a drive track. The strips of staples, such as shown by the strips of staples 48 and 50 shown in the phantom lines in FIG. 5, are placed in a magazine 72 of the staple gun 44. As best seen in FIG. 6, the magazine 72 has stationary walls 74 and 76 and movable walls 78 and 80. The walls 78 and 80 are slidably mounted with respect to the walls 74 and 76 and are moved by a pneumatically operated piston 82. When activated, the piston 82 moves the walls 78 and 80 away from the walls 74 and 76 so that the magazine 72 of the staple gun 44 is opened to receive a supply of staples.

Once the magazine 72 is so opened after its supply of staples has been exhausted, the staple gun 44 is positioned adjacent the exit chute 32 as shown in FIG. 5 so that an upper portion 84 of the magazine wall 76 is placed beneath a bottom wall 88 of the exit chute 32 adjacent to a bottom edge 90 of the exit chute 32 (see FIGS. 5, 10 and 11). As a result, an actuator 92 on the magazine 72 engages a contact arm 94 of the switch 46 and the switch 46 is closed. When the switch 46 is closed, a pusher cylinder 96 forming a part of the pusher mechanism 26 and connected by a coupler 98 to the pusher 42 moves the pusher 42 toward the pair of strips of staples 48 and 50 and toward the exit chute 32 (i.e., toward the left in FIG. 1) in a slot 100 in the base 60 and a slot 102 in a pusher guide 104.

Figure 8:
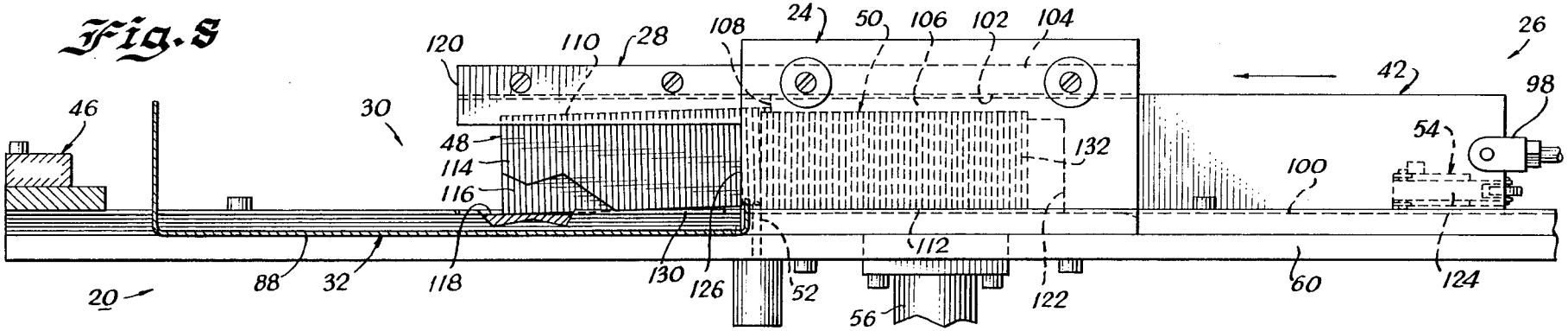
FIG. 8 is a sectional view taken along line 7—7 of FIG. 5 in the operational sequence of the feeder when the pusher has begun to separate the first strip of staples from the second strip of staples and has advanced the first strip of staples toward the exit chute.

The pusher 42 has a projecting leg 106 having a first pusher surface 108 spaced apart from the base 60 such that the pusher surface 108 is at a proper height to contact a crown portion 110 of the endmost staple in the strip 48. As the pusher 42 moves toward the exit chute 32, the strips of staples 48 and 50 both tend to move toward the exit chute 32. However, a crown portion 112 of the first staple in the strip of staples 50 engages or is stopped by the stop pin 52 (see FIGS. 4 and 8 of the drawings). Once the strip of staples 50 is stopped by the stop pin 52, the continued movement of the pusher 42 separates the strip of staples 48 from the strip of staples 50 as is illustrated in FIG. 8 of the drawings. As the strip of staples 48 is separated from the strip of staples 50, the upper portion of legs 114 which are positioned adjacent the inner wall 70 of the stop block 24 engage the guide 28 near the crown portions 110. In addition, the tips of the other legs 116 of the staples in the strip 48 slide within a slot 118 in the tumbling device 30 (see FIG. 11 of the drawings). Since the legs 114 lie against the guide 28 and the tips of the legs 116 are positioned in the slot 118, the strip 48 will not fall or tumble downwardly into the exit chute 32 until the strip 48 is past a far edge 120 of the guide 28.

While the legs 114 of the staples in the strip of staples 48 is still engaging the guide 28, the strip of staples 48 is completely separated from the strip of staples 50. At this point in the loading cycle, a second pusher surface 122 of the pusher 42 is positioned to engage the crown portion 112 of the endmost staple in the strip 50. In addition, the pusher 42 has advanced toward the exit chute 32 a sufficient amount that a contact arm 124 on the switch 54 is no longer held in an activated position so that the switch 54 opens (see FIGS. 8 and 9). Upon the opening of the switch 54, the stop pin 52 is retracted to a position such as shown in FIG. 9 of the drawings. When so retracted, the stop pin 52 no longer inhibits the movement of the strip of staples 50 and the continued movement of the pusher 42 moves the strip of staples 50 toward the exit chute 32.

The sizes of the staples to be used in the staple gun 44 can vary, particularly in the length of the legs of the staples, such as legs 114 and 116. In order to accommodate different sized staples, various different sized pushers 42 can be used with the pusher surfaces 108 and 122 being properly located to contact the crown portions of the strips of staples being used.

Once the strips of staples 48 and 50 are pushed to a position shown in FIG. 9, the strip of staples 48 is no longer in engagement with the guide 28 because the strip of staples 48 has moved beyond the edge 120 of the guide 28. In addition, the strip of staples 50 has been moved beyond a far edge 126 of the stop block 24. As a result, the strip of staples 48 begins to tumble down along the exit chute 32 toward the open magazine 72 of the staple gun 44 as illustrated in FIG. 11 of the drawings. As shown in FIG. 11 of the drawings, the tips of the legs 116 of the strip of staples 48 are caught in the slot 118 and the legs 114 of the strip of staples 48 is positioned beyond the tumbling device 30. Since the crown portions 110 of the staples in the strip 48 tend to be heavier than the remaining portion of the staples, the strip of staples 48 begins to tumble as illustrated by the strip of stapless 48 shown in phantom lines in FIG. 11. This tumbling of the strip of staples 48 results in the legs 114 lying against the bottom wall 88 of the exit chute 32 and the strip of staples 48 slides along the wall 88 toward the magazine 72 with the crown portions 110 facing toward the magazine 72. The strip of staples 48 comes to rest in the open magazine 72 with the crown portions 110 against the wall 74 and with the legs 114 against fingers 128 extending from the wall 76. This is best illustrated in the lower portion of FIG. 11.

At the same time that the strip of staples 48 is tumbling into the exit chute 32, the strip of staples 50 is also tumbling into the exit chute 32 as best illustrated in FIG. 10 of the drawings. As shown in FIG. 10, the crown portions 112 of the staples in the strip 50 lie against an upper surface 130 of the tumbling device 30 and ends of legs 132 of the staples in the strip 50 rests against the guide 28. Once the strip of staples 50 has been pushed beyond the edge 126 of the stop block 24, the crowns 112 of the staples in the strip 50 begin to slide off the upper surface 130 of the tumbling device 30 due in part to the fact that the upper surface is inclined downwardly as viewed in FIG. 10. The strip of staples 50 tumble as shown by the strips of staples 50 in phantom lines in FIG. 10. As a result of this tumbling action, the crown portions 112 slide towards the open magazine 72 with legs 134 of the staples in the strip 50 lying against the bottom wall 88 of the exit chute 32. Hence, the strip of staples 50 enter the magazine 72 and lie against the walls 74 and 76 of the open magazine 72 in the same orientation as the strip of staples 48. In other words, the crown portions 112 of the strip of staples 50 and the crown portions 110 of the strip of staples 48 both lie against the wall 74 with the legs 132 and 134 of the strip of staples 50 and the legs 114 and 116 of the strip of staples 48 extending away from the wall 74.

Figure 7:
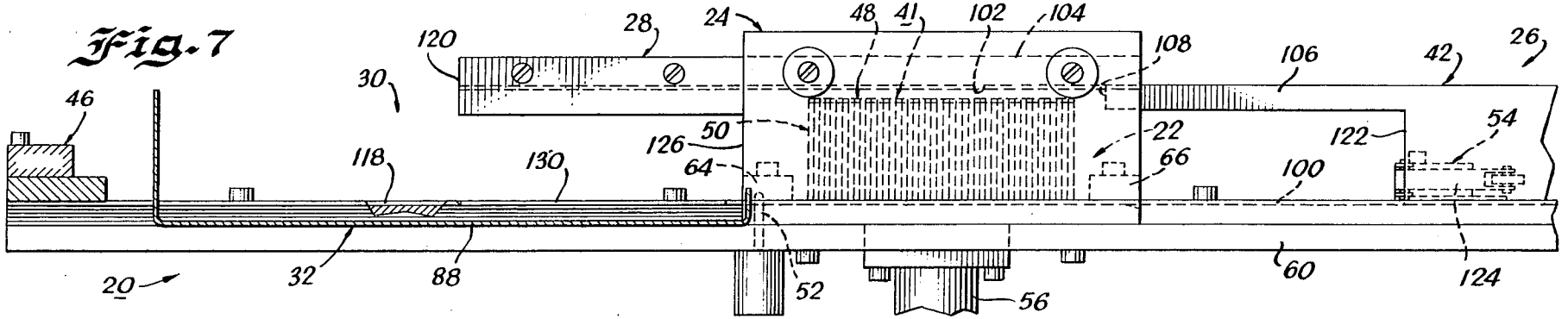
FIG. 7 is a sectional view taken along line 7—7 of FIG. 5 in the operational sequence of the feeder when the pusher is fully retracted.

After the staple gun 44 is so supplied with the strip of staples 48 and 50, the staple gun 44 is removed from adjacent the bottom edge 90 of the exit chute 32. When so removed, the contact arm 94 on the switch 46 is released by the actuator 92 and the switch 46 is again open. The opening of the switch 46 results in the pusher cylinder 96 retracting the pusher 42 to the position it is shown in FIGS. 1 and 7 of the drawings. When the pusher 42 is so retracted, the next nested together strips of staples 40 slide along the bottom wall 62 of the receiving bin 22 and become positioned against the inner wall 70 of the stop block 24. The loading cycle then can be repeated with, for example, the strips of staples 40 when a staple gun, such as the staple gun 44, is positioned with its open magazine 72 adjacent the bottom edge 90 of the exit chute 32.

As the staple gun 44 is removed from adjacent the exit chute 32, the magazine 72 is closed by the cylinder 82. More specifically, the cylinder 82 is actuated so that a piston rod 136 affixed at one end to the staple gun 44 near its drive track is retracted into the cylinder 82 resulting in the cylinder 82 moving toward the drive track or toward the right as the staple gun 44 is viewed in FIG. 5. The walls 78 and 80 are affixed to the cylinder 82 and will move along with the cylinder 82. As best seen in FIG. 6, the wall 78 has a slot 138 in which the upper portion 84 of the wall 76 slides and the wall 80 has a slot 140 in which a portion 142 of the wall 74 slides as the walls 78 and 80 are moved relative to the walls 74 and 76 as the magazine 72 is closed. In addition, a support 144 projecting from the wall 78 slides in between the legs 114 and 116 of the strip of staples 48 and the legs 132 and 134 of the strip of staples 50 so that the legs 114 and 134 are maintained against the fingers 128 projecting from the magazine wall 76. The magazine 72 also has a mechanism (not shown) to bias the strips of staples 48 and 50 toward the drive track located in the staple gun 44 so that as the staples in the strips 48 and 50 are used the next staple is in proper position within the drive track.

Although the present invention has been described with reference to one preferred embodiment thereof, it will be apparent that other modifications and embodiments can be devised by those skilled in the art which will fall within the spirt and scope of the present invention.

What is claimed and sought to be secured by Letters Patent of the United States is:

1. An apparatus for feeding a plurality of strips of staples to a fastener driving device, said plurality of strips of staples including first and second strips of staples nested together such that the legs of said first strip of staples extend in a direction opposite to the direction of the legs of said second strip of staples and one of the legs of each of the strips of staples is located in between the legs of the other strips of staples, said apparatus comprising:

an inclined receiving means for receiving at least said first and second strips of staples nested together, a positioning means for positioning said first and second strips of staples together at the lower end of said receiving means, an inclined exit means to which said first and second strips of staples are supplied to be loaded to in fastener driving device during each loading cycle of said feeding apparatus, pusher means for moving said first and second strips of staples from said positioning means toward said exit means, holding means for selectively holding said second strip of staples so as to maintain said second strip of staples stationary while said pusher means moves said first strip of staples toward said exit means, said holding means being selectively disengaged from said second strip of staples such that said pusher means moves both said first and second strips of staples toward said exit means, and tumbling means to orient said first and second strips of staples so that said first and second strips of staples are supplied through said exit means for loading into said fastener driving device in the same orientation.

2. The apparatus as set forth in claim 1 wherein said fastener driving device has a magazine for receiving said first and second strips of staples, said magazine having sides which are movable to allow said first and second strips of staples to be loaded at the same time along the length of the magazine during each loading cycle.

3. The apparatus as set forth in claim 1 including a first control means to activate said pusher means in response to said fastener driving device being positioned adjacent said exit means and a second control means responsive to the position of said pusher means to control said holding means.

4. The apparatus as set forth in claim 1 wherein said tumbling means has slot means and an inclined surface means which in part causes said first and second strips of staples to be supplied to said fastener driving device in the same orientation.

5. An apparatus for feeding a plurality of strips of detachably connected staples to a fastener driving device, said plurality of strips of staples including first and second strips of staples nested together, said apparatus comprising:

a bin means for receiving at least said first and said second strips of staples nested together, an exit chute for supplying said first and second strips of staples to said fastener driving device at substantially the same time, guide means associated with said bin means and said exit chute means, a pusher means for moving said first and second strips of staples toward said exit chute along said guide means, a stop means for selectively engaging said second strip of staples so as to enable said pusher means to separate said first strip of staples from said second strip of staples and to move said first strip of staples toward said exit chute, said stop means being selectively disengaged from said second strip of staples when said first strip of staples has been separated from said second strip of staples so that said pusher means moves both said first and second strips of staples toward said exit chute, and orienting means to orient said first and second strips of staples so that said first and second strips of staples are supplied to said exit chute in the same orientation for use in said fastener driving device.

6. The apparatus as set forth in claim 5 wherein said bin means is channel shaped having a bight wall and a pair of opposed leg walls extending from said bight wall such that said nested strips of staples fit between said opposed leg walls and move along said bight wall.

7. The apparatus as set forth in claim 5 wherein each staple in each of said first and second strips of staples has a crown portion and a pair of legs extending from said crown portion, said pusher means having a first pusher portion to engage the crown of one of said staples in said first strip of staples and having a second pusher portion to engage the crown portion of a staple in said second strip of staples.

8. The apparatus as set forth in claim 5 including a first control means activated when said fastener driving device is positioned relative to said exit chute, and a pusher driving means for moving said pusher means toward said exit chute and against said first and second strips of staples in response to the activation of said first control means.

9. The apparatus as set forth in claim 5 including a second control means responsive to the movement of said pusher means to selectively disengage said stop means from engagement with said second strip of staples when said first strip of staples has been separated from said second strip of staples.

10. The apparatus as set forth in claim 5 wherein said guide means maintains said first strip of staples away from said exit chute until said second strip of staples is properly positioned relative to said exit chute and said orienting means includes tumbling means to cause said first strip of staples to tumble into said exit chute in the same orientation as said second strip of staples.

11. The apparatus as set forth in claim 5 including support means supporting said bin means in an inclined position such that said first and second nested together strips of staples slide toward a position in alignment with said pusher means and supporting said exit chute means in an inclined position so that said first and second strips of staples slide downwardly into the fastener driving device after being oriented by said orienting means.

12. An apparatus for feeding a plurality of strips of detachably connected staples to a fastener driving device, each of said staples having a pair of legs extending from a crown portion, said feeding apparatus comprising:

a receiving chute into which strips of staples including at least first and second strips of staples are supplied in a nested configuration, a pusher for engaging said first and second strips of staples, guide means and stop block means along which said first and second strips of staples are pushed in response to engagement of said first and second strips of staples by said pusher, an exit chute through which said first and second strips of staples travel to said fastener during driving device, and orienting means including a slot into which first legs of the staples in the first strip of staples is disposed as said first strip of staples is pushed by said pusher and second legs of the staples in said first strip of staples are engaged by said guide means near the crown portion of said staples in said first strip of staples such that said first strip of staples tumbles into said exit chute so that said crown portions of said staples in said first strip enter the fastener driving tool first when the second legs are not in contact with said guide means and said orienting means including further an inclined support surface on which the crown portions of the staples in said second strip of staples rest and third legs of the staples in the second strip of staples are engaged by said stop block means and said guide means such that said second strip of staples tumbles into said exit chute so that said crown portions of said staples in said second strip enter the fastener driving tool first when the third legs are pushed beyond said stop block means.

13. The apparatus as set forth in claim 12 wherein said fastener driving device includes a magazine in which an elongated portion of the magazine is open so that the first and second strips of staples can be loaded into the magazine along the length of the magazine.

14. The apparatus as set forth in claim 12 wherein said pusher incudes a first projecting pusher surface which engages the crown portion of a staple in said first strip of staples and a second pusher surface displaced from the first pusher surface engages the crown portion of a staple in said second strip of staples.

* * * * *